US005393065A

United States Patent [19]

LeQuyea

[11] Patent Number: 5,393,065

[45] Date of Patent: Feb. 28, 1995

[54] PUTTING PRACTICE DEVICE

[76] Inventor: Brian D. LeQuyea, 29251 Anderson Rd., Wickliffe, Ohio 44092-2337

[21] Appl. No.: 228,887

[22] Filed: Apr. 18, 1994

[51] Int. Cl.[6] ..... A63B 69/36

[52] U.S. Cl. ..... 273/192; 273/DIG. 30; 273/187.1

[58] Field of Search ..... 273/192, 191 R, 191 A, 273/191 B, 186.1, 187.1, DIG. 30

[56] References Cited

U.S. PATENT DOCUMENTS

| | | | |
|---|---|---|---|
| 3,332,688 | 7/1967 | Gevertz | 273/192 X |
| 3,482,838 | 12/1969 | Gibson et al. | 273/191 R X |
| 3,753,563 | 8/1973 | Previte | 273/195 B X |
| 3,868,116 | 2/1975 | Ford et al. | 273/192 X |
| 3,885,796 | 5/1975 | King | 273/192 X |
| 3,899,180 | 8/1975 | Rofman | 273/192 X |
| 4,453,717 | 6/1984 | Solheim et al. | 273/192 |
| 5,011,154 | 4/1991 | Bowen | 273/192 X |
| 5,131,659 | 7/1992 | Lindberg | 273/192 X |
| 5,246,233 | 9/1993 | Sheltman et al. | 273/186.1 |
| 5,282,627 | 2/1994 | Beck | 273/192 X |

*Primary Examiner*—George J. Marlo

*Attorney, Agent, or Firm*—Robert R. Hussey Co.

[57] ABSTRACT

A golf putting practice device is provided for use on a support surface by golfers to improve their ability to putt a golf ball and includes a substantially rectangular strip of flexible sheet material forming a putting surface member which can be rolled up for storage. The putting surface member has a putting surface, a bottom surface opposite the putting surface, and an outer edge portion. The putting practice device includes an outer guide rail and means for securing the outer guide rail to the putting surface member along the outer edge portion thereof. The outer guide rail has a putting surface portion and a guide portion extending upwardly of the putting surface. The putting practice device also includes an inner guide rail having a putting surface portion and a guide portion extending upwardly of the putting surface. Means are provided for removably securing the inner guide rail to the putting surface member with the guide portion of the inner guide wail substantially parallel to the guide portion of the outer guide rail. The putting practice device also includes means for frictionally engaging the support surface.

15 Claims, 4 Drawing Sheets

PUTTING PRACTICE DEVICE

BACKGROUND OF THE INVENTION

The present invention relates generally to golf putting practice devices and in particular to such devices that aid a golfer in perfecting his putting stroke.

It is well recognized that a very important part of a golfers game is putting accuracy. It is further recognized that more strokes can be gained or lost on or around the green because of putting than any other place on the golf course. It has been stated that approximately 50% of the strokes used in completing a round of golf on a par 72 regulation length golf course are for putting alone.

The importance of putting is further accentuated since putting for most players is one of the most difficult skills to master. Variables such as grip, stance, backswing, downswing, followthrough, club speed, club direction, and perpendicularity of club face to intended path of the ball at the time of impact must be simultaneously taken into account. For example, the slightest deviation of either the squareness of the club in the direction of the intended path of the ball on impact or accuracy of the direction of the club with the initial direction of the ball on impact will cause the ball so struck to deviate from the desired path. Perfecting a swing of the putter that takes these variables into account and is consistently repeatable is the objective of the golfer.

Practice of the putting swing allows the golfer to perfect the combination of these variables until the repeatability of the putting stroke is achieved. When practicing, the golfer constantly corrects these variables until the desired swing is attained and then continues to practice until the swing becomes natural and is consistently repeatable.

Accordingly, it is desirable to provide a putting practice device that guides the head of the putter in the same direction as the initial direction of the ball on impact. It is also desirable to provide an indication of the squareness or perpendicularity of the club in the direction of the intended path of the ball on impact. Likewise, it is desirable to provide an indication of the amount of backswing of the putter.

Putters have a wide variety of club head shapes and lengths and each have a "sweet spot" that upon impact with the ball does not twist the putter head as a result of that impact. If the putter head twists upon impact and follow through, the ball does not follow the desired course. Accordingly, it is desirable to provide a putting practice device that properly positions the ball to be impacted by the "sweet spot" of the putter and is adjustable to accommodate various sizes and configurations of putter heads. Likewise, it is desirable to guide the heads of various sizes and configurations of putter heads in the same direction of the ball on impact.

The opportunity to practice putting arises both outdoors and indoors. Practice putting greens are available to a golfer and allow for practice in actual playing conditions with additional playing variables of playing surface curvature and green speed. It is desirable to provide a putting practice device that can be used under these conditions. When so used, it is important that the putting practice device remain stationary with the ground and not move when in use and when the practice session is completed is readily removable from engagement with the ground.

Likewise when a putting practice device is used indoors on such floor surfaces as carpet, it is desirable that the putting practice device remain stationary with the floor and not move when in use and when the practice session is completed is readily removable from engagement with the floor. Also, when used indoors it is desirable to provide a putting practice device that has some degree of flexibility so as to decrease the possibility of injury as a result of contact with the device.

To conveniently carry or store a putting practice device, it is desirable to provide such a device that is readily portable so that it can be easily carried such as in a golf bag or otherwise conveniently stored.

SUMMARY OF THE PRESENT INVENTION

The present invention provides the above described desirable features with an improved putting practice device. The golf putting practice device of the present invention is provided for use on a support surface by golfers to improve their ability to putt a golf ball and includes a substantially rectangular strip of flexible sheet material forming a putting surface member. The putting surface member has a putting surface, a bottom surface opposite the putting surface, and an outer edge portion.

The putting practice device includes an outer guide rail and means for securing the outer guide rail to the putting surface member along the outer edge portion thereof. The outer guide rail has a putting surface portion and a guide portion extending upwardly of the putting surface.

The putting practice device of the present invention also includes an inner guide rail having a putting surface portion and a guide portion extending upwardly of the putting surface. Means are provided for removably securing the inner guide rail to the putting surface member with the guide portion of the inner guide rail substantially parallel to the guide portion of the outer guide rail. The putting practice device of the present invention also includes means for frictionally engaging the support surface.

The putting practice device of the present invention provides the desirable features described above. The pro,sent invention provides a putting practice device that guides the head of the putter in the same direction as the initial direction of the ball on impact. The inner and outer guide rails guide the head of the putter as it is moved through the stroke of the putter.

Lines are provided on the putting surface of the putting surface member to provide an indication of the squareness or perpendicularity of the club in the direction of the intended path of the ball on impact and an indication of the amount of backswing of the putter.

The present invention provides a putting practice device that properly positions the ball to be impacted by the "sweet spot" of the putter and is adjustable to accommodate various sizes and configurations of putter heads. The present invention also provides a putting practice device that is adjustable to guide the heads of various sizes and configurations of putter heads in the same direction of the ball on impact.

The golf putting practice device of the present invention may be used both indoors and outdoors. The means for frictionally engaging the support surface is capable of engaging both indoor and outdoor surfaces, such as carpet or practice putting greens. When the practice session is completed, the golf putting practice device is readily removable from engagement with the support surface.

The present invention provides a putting practice device that has some degree of flexibility so as to decrease the possibility of injury as a result of contact with the device. The golf putting practice device of the present invention also provides the desirable feature of being readily portable so that it can be easily carried such as in a golf bag or otherwise conveniently stored.

Other desirable features and advantages of the present invention will become apparent from a study of the following description and the accompanying drawings which are illustrative of the invention.

DETAILED DESCRIPTION OF THE INVENTION

Figure 1:
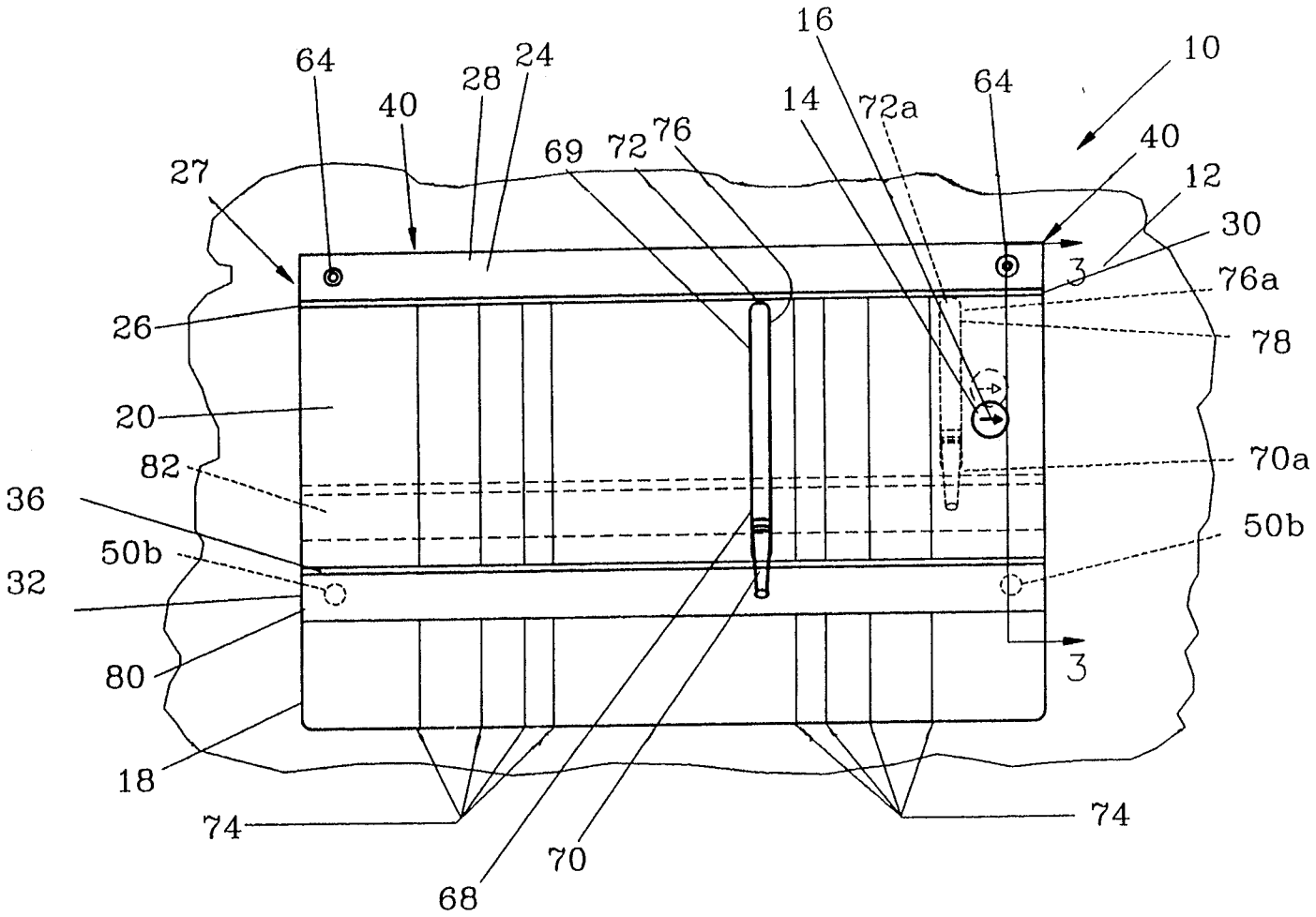
FIG. 1 is a top view of the golf putting practice device of the present invention.
Figure 2:
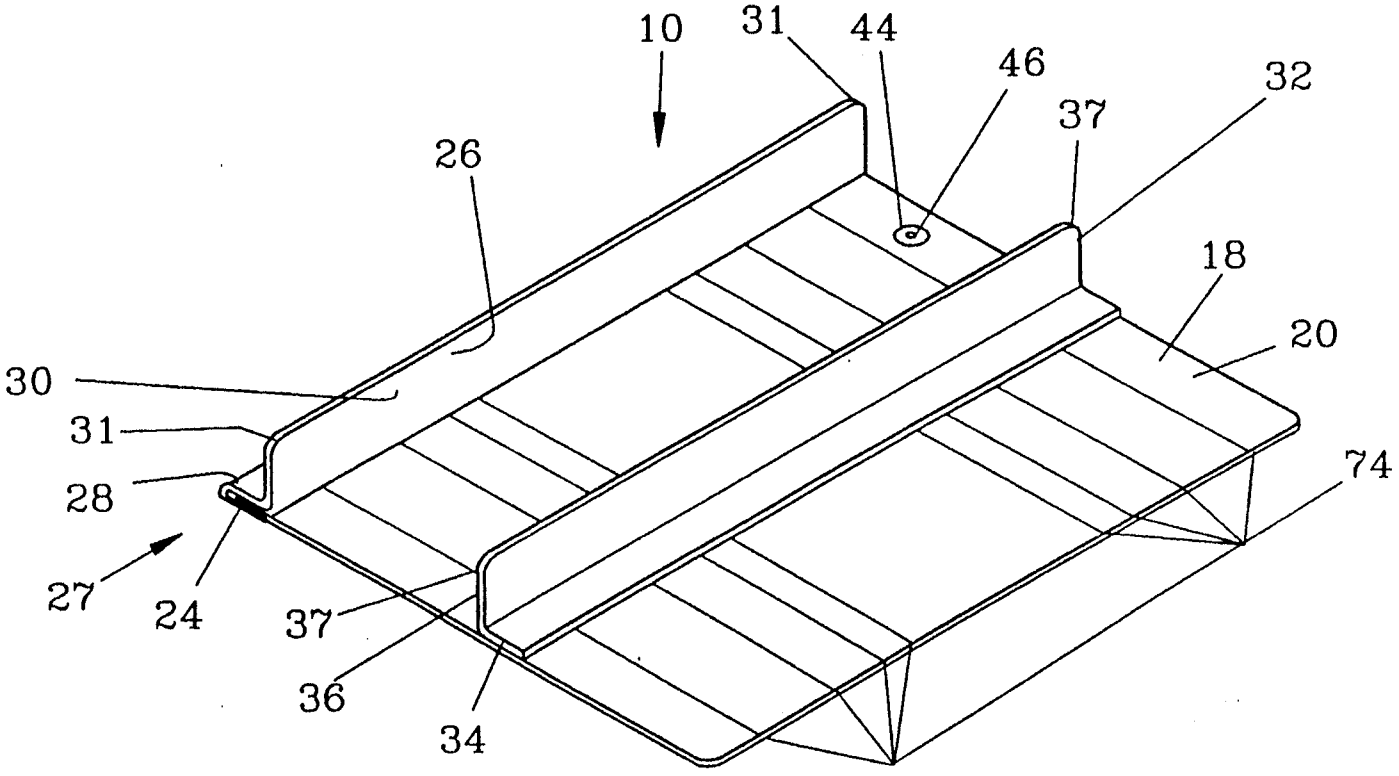
FIG. 2 is a perspective view of the golf putting practice device shown in FIG. 1.

A golf putting practice device 10 is provided as shown in FIGS. 1 and 2 for use on a support surface generally indicated at 12 by golfers to improve their ability to putt a golf ball 14. It should be understood that any conventional golf ball 14 may be utilized in conjunction with the present invention. The preferred embodiment of the present invention includes a golf ball 14 having an arrow 16 thereon as will be herein further described.

Figure 3:
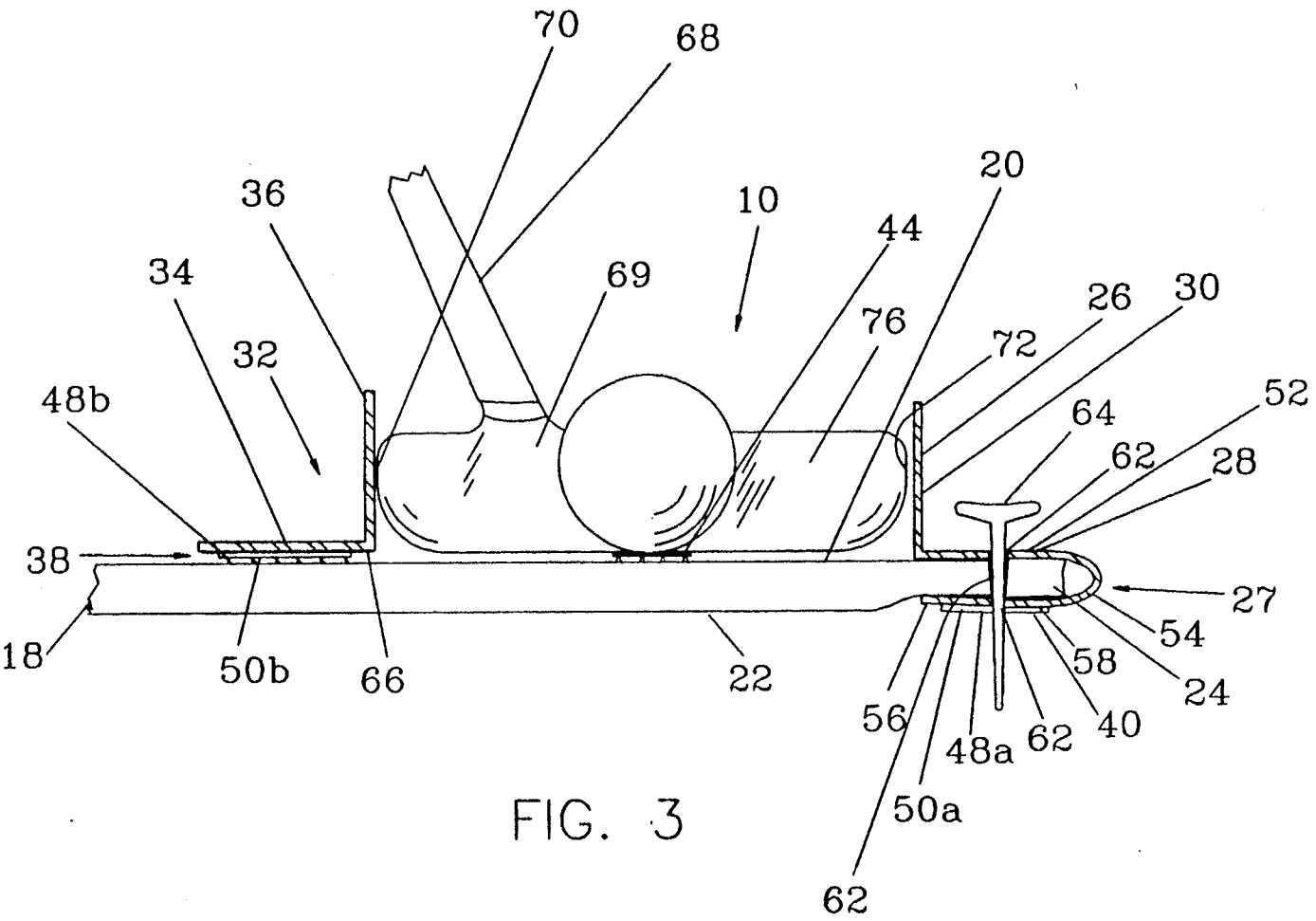
FIG. 3 is a fragmentary sectional view of the golf putting practice device shown in FIG. 1 taken along lines 3—3 thereof.

The golf putting practice device 10 of the present invention includes a substantially rectangular strip of flexible sheet material forming a putting surface member 18. As seen in FIGS. 1 and 3, the putting surface member 18 has a putting surface 20, a bottom surface 22 opposite the putting surface 20, and an outer edge portion 24. The putting practice device 10 also includes an outer guide rail 26 and means, generally indicated at 27, for securing the outer guide rail to the putting surface member 18 along the outer edge portion 24 thereof. The outer guide rail 26 has a putting surface portion 28 and a guide portion 30 extending upwardly of the putting surface portion 28. The guide portion 30 has rounded ends 31 as a safety feature. The putting practice device 10 also includes an inner guide rail 32 having a putting surface portion 34 and a guide portion 36 extending upwardly of the putting surface portion 28. The guide portion 36 has rounded ends 37 as a safety feature.

Means 38 are provided for removably securing the inner guide rail 32 to the putting surface member 18 with the guide portion 36 of the inner guide rail 32 substantially parallel to the guide portion 30 of the outer guide rail 26. The putting practice device 10 also includes means 40 for frictionally engaging the support surface 12.

Figure 4:
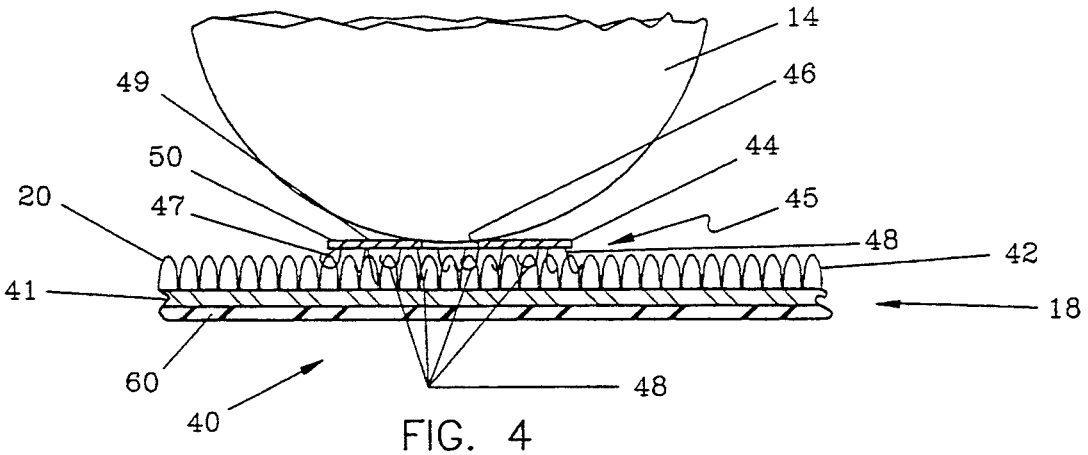
FIG. 4 is an expanded partial sectional view of the golf putting practice device shown in FIG. 3.

In the preferred embodiment of the present invention, the substantially rectangular strip of flexible sheet material forming a putting surface member 18 is preferably made from carpet having a base 41 with a plurality of closed loops 42 forming the putting surface 20 as seen in FIG. 4. It should be understood that it is within the contemplation of this invention that the putting surface 20 may be formed from any material that provides a putting surface.

As seen in FIGS. 3 and 4, the golf putting practice device 10 of the present invention includes a ball positioning member 44 having a depression 46 in the upper surface 49 of the member 44 for receiving the golf ball 14 therein. When the ball positioning member 44 is positioned on the putting surface member 18, the golf ball 14 may be positioned in a desirable location on the putting surface 20 as will be herein further described.

The bottom 47 of the ball positioning member 44 includes means 45 for removably securing the ball positioning member to the putting surface such as a series of randomly formed hooks 48 secured to the base 50 of the ball positioning member. When the hooks 48 are pressed into contact with the loops 42 of the putting surface member 18, the hooks grip the loops to removably secure the ball positioning member 44 to the putting surface member 18.

The ball positioning member 44 may be removed from the putting surface member 18 and repositioned and secured to the putting surface member in the new position. One product that provides such removable securement is the product of synthetic materials which adhere when pressed together sold under the trademark VELCRO. It should be understood that other means 45 for removably securing the ball positioning member 44 to the putting surface member 18 is fully within the contemplation of this invention.

Removable securing means 40, 38 are used to connect other components of the golf practice putting device 10 of the present invention and are similar in construction to the removable securing means 45. For ease of description, these removable securing means are numbered with numerals the same as used in connection with the removable securing means 45 to denote common parts where appropriate and followed by the suffix letters "a" and "b" to denote the particular removable securing means.

The outer guide rail 26 of the putting practice device 10 is secured by means, generally indicated at 27, to the putting surface member 18 along the outer edge portion 24 thereof as seen in FIG. 3. The putting surface portion 28 of the outer guide rail 26 has top, side and bottom portions 52, 54, and 56 respectively. The outer edge portion 24 of the putting surface member 18 is received between the top and bottom portions 52, 56 and compressed therebetween so that the means 27 for securing the outer glide rail 26 to the putting surface member 18 is provided.

The golf putting practice device 10 of the present invention includes means 40 for frictionally engaging the support surface 12 as seen in FIGS. 1 and 3. When the support surface 12 is carpet, the means 40 includes a base 50*a* secured by any conventional means such as an adhesive to the bottom 58 of the bottom portion 56 of the outer guide rail 26. The support surface 12 is engaged by a series of randomly formed hooks indicated at 48*a* extending from the base 50*a* to create frictional engagement of the golf putting practice device 10 with the support surface 12.

As seen in FIG. 4, the putting surface member 18 includes a frictional backing material 60 such as rubberized material secured to the base 41. The frictional material 60 is in contact with the support surface 12 when the putting practice device 10 is in use and provides means 40 for frictionally engaging the support surface 12. For example, when the support surface 12 is a smooth hard surface, the frictional backing material 60 will serve as means 40 for frictionally engaging the support surface 12.

In other situations, the putting practice device 10 is used outdoors on putting practice greens. When the support surface 12 is a putting practice green, the present invention provides means 40 for frictionally engaging the putting practice green 12 including apertures 62 through the top and bottom portions 52, 56 respectively of the outer guide rail 26 and through the outer edge portion 24 of the putting surface member 18 shown in FIGS. 1 and 3. The means 40 for frictionally engaging the putting practice green 12 includes pin members such as golf tees 64, shown in FIG. 3, which are inserted through the apertures 62 and into the putting practice green 12. It is within the contemplation of this invention that the means 40 may include any one or all of the devices described above, base 50*a* and hooks 48*a*, or frictional backing material 60, or apertures 62 and tees 64 for frictionally engaging the support surface 12.

The putting practice device 10 also includes an inner guide rail 32 having a putting surface portion 34 and a guide portion 36 extending upwardly of the putting surface 20. Preferably, the inner and outer guide rails 32, 26 respectively are made from a flexible material such as plastic. It should be understood that it is within the contemplation of this invention to make the rails 32, 26 from a rigid material.

Means 38 are provided for removably securing the inner guide rail 32 to the putting surface member 18 with the guide portion 36 of the inner guide rail 32 substantially parallel to the guide portion 30 of the outer guide rail 26 as seen in FIGS. 1 and 3. The means 38 includes bases 50*b* secured by any conventional means such as an adhesive to the bottom 66 of the putting surface portion 34 of the inner guide rail 32. The putting surface member 18 is engaged by a series of randomly formed hooks 48*b* extending from the bases 50*b* to provide frictional engagement of the inner guide rail 32 with the putting surface member 18. It should be understood that other means 38 for removably securing the ball positioning member 44 to the putting surface member 18 is fully within the contemplation of this invention.

As seen in FIGS. 1 and 3, a putter 68 is shown in solid lines and has a head 69 with a head size or length measured from its inner end 70 to its outer end 72. The inner guide rail 32 is positioned substantially parallel to the outer rail guide 26 so the distance between the guide portion 30 of the outer rail guide 26 and the guide portion 36 of the inner rail guide 32 is substantially equal to the distance between the inner and outer ends 70, 72 respectively of the putter 68.

Lines 74 are provided on the putting surface 20 of the putting surface member 18 parallel to each other and perpendicular to the guide portion 30 of the outer rail guide 26 and the guide portion 36 of the inner rail guide 32. Two sets of lines 74 are provided so that the putting practice device 10 may be used by both right and left handed golfers. The ball positioning member 44 is positioned on the putting surface member 18 so that the golf ball 14, when seated in the depression 46, is aligned with the proper contact area or "sweet spot" of the hitting surface 76 of the putter 68. The ball positioning member 44 is positioned on the opposite end of the putting surface 20 than that shown when an opposite handed player uses the putting practice device 10. The opposite handed player will use the set of lines 74 at the opposite end of the putting surface 20. As can be seen from the above, the putting practice device of the present invention may be used by both a right or a left handed golfer.

When the golfer practices his putting stroke the guide rails 24 and 32, ball 14 and ball positioning member 44 are positioned as described above. The golfer places the head 69 of the putter 68 between the guide rails 24, 32 so the ends 72, 70 respectively are adjacent thereto. The hitting surface 76 of the putter 68 faces the ball 14 positioned on the ball positioning member 44. The hitting surface 76 is also parallel to the lines 74.

As the golfer swings the putter 68, he can gage the length of his stroke by the particular line 74 that the hitting surface 76 of the putter 69 is aligned with. As he moves the putter 68 toward the ball 14, contact between the guide rails 24, 32 and the ends 72, 70 respectively corrects movement of the putter 68 in the direction of the lines 74. The arrow 16 on the ball 14 is oriented so that it is seen by the golfer and is in the direction of movement of the putter 68 and accordingly assists the golfer in moving the putter in the desired direction. Variables such as grip, stance, backswing, downswing, followthrough, club speed, club direction,and perpendicularity of club face to intended path of the ball at the time of impact must be simultaneously taken into account. The present invention provides a putting practice device 10 that assists the golfer in constantly correcting these variables until the desired swing is attained and then provides for continued practice until the swing becomes natural and is consistently repeatable.

The means 38 allows the inner guide rail 32 to be moved from one position to the other. For example, different putters have different head lengths. In FIG. 1 another putter 78 is shown in dashed lines and is similar in construction to the putter 68. For ease of description, the putter 78 is numbered with numerals the same as used in connection with the putter 68 to denote common parts where appropriate and followed by the suffix letter "a" to denote the putter 78. Since the distance between the inner and outer ends 70*a*, 72*a* respectively of the putter 78 is less than the distance between the inner and outer ends 70, 72 respectively of the putter 68, the inner guide rail 32 must be moved toward the outer guide rail 26.

To move the inner guide rail 32 from the position 80 indicated in solid lines in FIG. 1, the inner guide rail is pulled away from the putting surface member 18 and the means 38 releases from engagement with the putting surface member 18. The hooks 48*b* release their engagement with the putting surface member 18.

The head 69*b* of the putter 78 is then positioned between the outer guide rail 26 and the inner guide rail 32 so that the inner end 70*a* is in contact with the inner guide rail 32 and the outer end 72*a* is in contact with the outer guide rail 26. The inner guide rail 32 is then positioned parallel to the outer guide rail 26 in position 82 and pressed toward the putting surface member 18 so the hooks 48*b* engage the putting surface member.

The ball positioning member 44 is likewise removed from engagement with the putting surface member 18. The ball positioning member 44 is positioned on the putting surface member 18 so that the golf ball 14, when seated in the depression 46, is aligned with the proper contact area or "sweet spot" of the hitting surface 76*a* of the putter 78.

Figure 5:
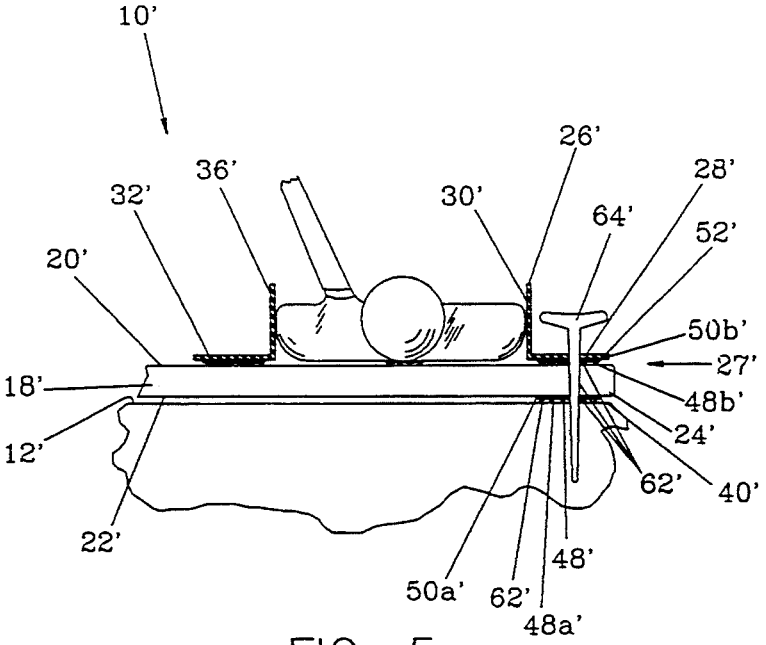
FIG. 5 is a fragmentary sectional view of an another embodiment of the golf putting practice device of the present invention.

The golf putting practice device of the present invention also provides the desirable feature of being readily portable so that it can be easily carried such as in a golf bag or otherwise conveniently stored. Since the putting surface member 18 is flexible, the inner guide rail 32 may be removed from engagement with the putting surface member and be rolled up inside the flexible surface member. This feature provides a compact sized golf putting practice device that can be easily carried such as in a golf bag or otherwise conveniently stored. Another embodiment of the putting practice device 10' of the present invention is shown in FIG. 5 and is similar in construction with the putting practice device 10 described above. For ease of description, the putting practice device 10' is numbered with numerals the same as used in connection with the putting practice device 10 to denote common parts where appropriate and followed by a prime mark "'" to denote the putting practice device 10'.

The putting practice device 10' provides an alternate construction of the outer guide rail 26', means 27' for securing the outer guide rail 26' to the putting surface member 18', and means 40' for frictionally engaging the support surface 12'.

The outer guide rail 26' of the putting practice device 10' is secured by means, generally indicated at 27', to the putting surface member 18' along the outer edge portion 24' thereof as seen in FIG. 5. The outer guide rail 26' has a putting surface portion 28' and a guide portion 30' extending upwardly of the putting surface portion 28'. The putting surface portion 28' of the outer guide rail 26' has a top portion 52'.

Means 27' are provided for removably securing the outer guide rail 26' to the putting surface member 18' with the guide portion 30' of the outer guide rail 26' substantially parallel to the guide portion 36' of the inner guide rail 32'. The means 27' includes a pair of bases 50*b'* spaced along the length of the outer guide rail 26' and secured by any conventional means such as an adhesive to the bottom of the putting surface portion 28' of the outer guide rail 26'. The putting surface member 18' is engaged by a series of randomly formed hooks 48*b'* extending from the bases 50*b* ' to provide frictional engagement of the outer guide rail 26' with the putting surface member 18'.

The golf putting practice device 10' of the present invention includes means 40' for frictionally engaging the support surface 12'. The means 40' includes a base 50*a'* secured by any conventional means such as an adhesive to the bottom surface 22' of the putting surface member 18' along the outer edge portion 24' thereof. The support surface 12' is engaged by a series of randomly formed hooks, indicated at 48*a'*, extending from the base 50*a'* to create frictional engagement of the golf putting practice device 10' with the support surface 12'.

When the support surface 12' is for example a putting practice green, the present invention provides means 40' for frictionally engaging the putting practice green 12' including apertures 62' through the top portion 52' of the outer guide rail 26', through the outer edge portion 24' of the putting surface member 18', and through the bases 50*a'* and 50*b'*. The means 40' for frictionally engaging the putting practice green 12' includes pin members such as golf tees 64', which are inserted through the apertures 62' and into the putting practice green 12'.

The invention has been described with reference to the preferred embodiments. Obviously, modifications and alterations will occur to others upon reading and understanding of this specification. It is my intention to include all modifications and alterations insofar as they come within the scope of the appended claims or equivalents thereof.

What is claimed is:

1. A putting practice device for use on a support comprising:

(a) a strip of flexible sheet material forming a putting surface member which can be rolled up for storage, said putting surface member having a putting surface and a bottom surface opposite said putting surface; said putting surface member having an outer edge portion:

(b) an outer guide rail:

(c) means for securing said outer guide rail to said putting surface member along said outer edge portion: said outer guide rail having a putting surface portion positioned adjacent said putting surface of said putting surface member and a guide portion extending upwardly of said putting surface portion:

(d) an inner guide rail having a putting surface portion and a guide portion extending upwardly of said putting surface portion:

(e) means for removably securing said putting surface portion of said inner guide rail adjacent said putting surface of said putting surface member with the guide portion of said inner guide rail substantially parallel to said guide portion of said outer guide rail: and (f) means for frictionally engaging the support.

2. A putting practice device for use on a support as described in claim 1 including a movable ball positioning member having an upper surface with a depression therein for positioning a ball thereon and a bottom surface having means for removably securing said movable ball positioning member to said putting surface of said putting surface member.

3. A putting practice device for use on a support as described in claim 1 wherein said means for frictionally engaging the support includes a frictional surface forming said bottom surface of said putting surface member.

4. A putting practice device for use on a support as described in claim 1 wherein said means for frictionally engaging the support includes at least one aperture in said device and at least one pin member positioned through said aperture and received on the support.

5. A putting practice device for use on a support as described in claim 1, said putting surface member having a plurality of substantially parallel lines on said putting surface, said lines being substantially perpendicular to said guide portions of said inner and outer guide rails.

6. A putting practice device for use on a support as described in claim 1, said outer guide rail having a putting surface gripping portion having top and bottom portions for receiving and gripping said outer edge portion of said putting surface member therebetween.

7. A putting practice device for use on a support as described in claim 1, said putting surface member comprising a base portion, a plurality of closed loops forming said putting surface, and a frictional material secured to said base of said putting surface member and forming said bottom surface of said putting surface member.

8. A putting practice device for use on a support comprising:

(a) a strip of flexible sheet material forming a putting surface member which can be rolled up for storage, said putting surface member having a putting surface and a bottom surface opposite said putting surface; said putting surface member having an outer edge portion:

(b) an outer guide rail having a putting surface gripping portion having top and bottom portions for receiving and gripping said outer edge portion of said putting surface member therebetween; said outer guide rail including a guide portion extending upwardly of said putting surface;

(c) an inner guide rail having a putting surface portion and a guide portion extending upwardly of said putting surface; and (d) means for removably securing said putting surface portion of said inner guide rail to said putting surface of said putting surface member with the guide portion of said inner guide rail substantially parallel to said guide portion of said outer guide rail.

9. A putting practice device for use on a support as described in claim 8 including a movable ball positioning member having an upper surface with a depression therein for positioning a ball thereon and a bottom surface having means for removably securing said movable ball positioning member to said putting surface of said putting surface member.

10. A putting practice device for use on a support as described in claim 8 including means for frictionally engaging the support.

11. A putting practice device for use on a support as described in claim 10 wherein said means for frictionally engaging the support includes a frictional surface forming said bottom surface of said putting surface member.

12. A putting practice device for use on a support as described in claim 10 wherein said means for frictionally engaging the support includes at least one aperture in said device and at least one pin member positioned through said aperture and received on the support.

13. A putting practice device for use on a support as described in claim 8, said putting surface member having a plurality of substantially parallel lines on said putting surface, said lines being substantially perpendicular to said guide portions of said inner and outer guide rails.

14. A putting practice device for use on a support as described in claim 8, said outer guide rail having a putting surface gripping portion having top and bottom portions for receiving and gripping said outer edge portion of said putting surface member therebetween.

15. A putting practice device for use on a support as described in claim 8, said putting surface member comprising a base portion, a plurality of closed loops forming said putting surface, and a frictional material secured to said base of said putting surface member and forming said bottom surface of said putting surface member.

* * * * *